US006662759B2

(12) United States Patent
Hyp

(10) Patent No.: US 6,662,759 B2
(45) Date of Patent: Dec. 16, 2003

(54) TEMPORARY PLUG COVER FOR HOLE OR PORT IN STEAM GENERATOR OF NUCLEAR POWER PLANT

(75) Inventor: Edward J. Hyp, 11169 Larwin La., North Huntingdon, PA (US) 15642

(73) Assignee: Edward J. Hyp, North Huntingdon, PA (US)

( * ) Notice: Subject to any disclaimer, the term of this patent is extended or adjusted under 35 U.S.C. 154(b) by 0 days.

(21) Appl. No.: 10/227,299

(22) Filed: Aug. 26, 2002

(65) Prior Publication Data

US 2003/0047145 A1 Mar. 13, 2003

Related U.S. Application Data

(60) Provisional application No. 60/315,919, filed on Aug. 29, 2001.

(51) Int. Cl.[7] ..... G21C 13/06
(52) U.S. Cl. ..... 122/497; 376/206
(58) Field of Search ..... 122/459, 499, 122/497; 134/167 R, 172, 198; 376/205, 206

(56) References Cited

U.S. PATENT DOCUMENTS

| | | | | |
|---|---|---|---|---|
| 4,192,053 A | | 3/1980 | Blanco et al. | 29/157.4 |
| 4,524,729 A | | 6/1985 | Hill, Jr. et al. | 122/498 |
| 4,624,824 A | | 11/1986 | Dooley | 376/204 |
| 4,860,919 A | | 8/1989 | Weisel et al. | 220/240 |
| 4,932,553 A | | 6/1990 | Reich, Jr. et al. | 220/252 |
| 4,948,981 A | | 8/1990 | Wallace et al. | 250/517.1 |
| 5,094,809 A | * | 3/1992 | Lenoble et al. | 376/206 |
| 5,423,351 A | * | 6/1995 | Keating | 138/89 |
| 5,850,423 A | | 12/1998 | Rusnica, Jr. et al. | 376/204 |
| 6,609,908 B2 | * | 8/2003 | Guilmette et al. | 432/250 |

FOREIGN PATENT DOCUMENTS

| | | | |
|---|---|---|---|
| JP | 405172982 | 7/1993 | 376/203 |

* cited by examiner

*Primary Examiner*—Gregory Wilson

(57) ABSTRACT

A temporary cover is plugged into an open handhole or inspection port in a steam generator or another pressure vessel of a nuclear power plant after bolted covers are removed for maintenance inside the generator or vessel. The temporary cover may be locked to prevent foreign objects from entering the generator or vessel. The cover is vented at inclined angles so that air or gas may pass therethrough but is shielded so that gamma rays, which are the most penetrating type of radiation, are greatly reduced and dispersed away from personnel.

18 Claims, 6 Drawing Sheets

TEMPORARY PLUG COVER FOR HOLE OR PORT IN STEAM GENERATOR OF NUCLEAR POWER PLANT

CROSS REFERENCE TO RELATED APPLICATION

This application is related to and claims domestic priority from U.S. Provisional Patent Application Ser. No. 60/315,919 filed on Aug. 29, 2001.

BACKGROUND OF THE INVENTION

1. Field of the Invention

This invention relates to a steam generator of a nuclear power plant and, in particular, to a temporary plug cover for a hole or a port in the steam generator.

2. Description of the Related Art

The prior art references developed as a result of a preliminary patentability search are listed below.

| U.S. Pat. No. | Inventor(s) | Issue Date |
|---|---|---|
| 5,850,423 | Rusnica, Jr. et al. | Dec. 15, 1998 |
| 4,948,981 | Wallace et al. | Aug. 14, 1990 |
| 4,932,553 | Reich, Jr. et al. | Jun. 12, 1990 |
| 4,860,919 | Weisel et al. | Aug. 29, 1989 |
| 4,624,824 | Dooley | Nov. 25, 1986 |
| 4,524,729 | Hill, Jr. et al. | Jun. 25, 1985 |
| 4,192,053 | Blanco et al. | Mar. 11, 1980 |
| **Foreign Patent** | **Inventor** | **Publ. Date** |
| JP 5-172982 | Maekawa | Jul. 13, 1993 |

We note at the outset that the search had not developed any references which taken alone or in combination might be considered to anticipate or render obvious the combination of features in the invention. So, the above references are considered as being of secondary interest.

Rusnica, Jr. et al., Weisel et al. and Dooley show various types of plugs for sealing holes or openings in reactor-related apparatuses. However, none have any significant teaching of the features of the present invention.

Wallace et al., Reich, Jr., et al. and Blanco et al. show the use of lead shielding in reactor-related covers or doors. In the patent to Wallace et al., see the language of col. 2 at line 53. In the patent to Reich, Jr. et al., see the language of col. 4 at line 8. The patent to Blanco et al. teaches both lead shielding as well as the use of openings in the shield for the insertion of a camera. See the embodiment of FIGS. 12 and 13 along with the description of col. 4 beginning at line 60.

Japanese Kokai No. 5-172982 to Maekawa provides a teaching in FIG. 4 of a scheme for securing a cover 20 to a steam generator opening using a nut screwed onto what could be a captive bolt in a blind hole anchored in a vessel wall.

SUMMARY OF THE INVENTION

The present invention is characterized by three distinct structural features of a cylindrical cover used temporarily to plug an opening in a steam generator. The features are: an integrally formed lead shielding layer; radiation channeling and diffusing ventilation holes; and a mechanical retainer.

The cover is particularly adapted for temporarily closing openings in a steam generator associated with a nuclear power plant. The cover is cylindrically shaped to fit snugly into round openings in the vessel walls, such as man holes, hand holes, inspection ports, and the like, during maintenance.

As disclosed in a first embodiment which is one of three illustrative embodiments, a cylindrical sleeve formed of stainless steel may have a diameter in the range of several inches and include a layer of lead plate shielding on its inner face. The layer of lead plate may have a thickness of two inches or more. An elongated retaining bar is affixed to its outer face. An array of nominally longitudinal vent holes are drilled through the lead plate. Each hole is typically oriented at a 7 to 25 degree angle to the longitudinal axis. This angle depends upon the diameter of the temporary cover used. The angled holes allow ventilation through the lead plate but channel and diffuse radiation that is axial to the plate away from an operator. During maintenance of the steam generator, any handhole or inspection port that is opened is temporarily fitted with a cover of suitable diameter and retained in place by the elongated bar which is anchored to a flange by a lock which engages a slot permanently cut in the elongated bar.

In a second embodiment, the elongated bar is secured directly to a flange of the handhole or the inspection port. In a third embodiment, two of the ventilation holes are enlarged in diameter to allow the insertion of a camera and/or a retrieval tool into the generator.

Other objects and features of the present invention will become apparent from the following detailed description when considered in connection with the accompanying drawings which illustrate preferred embodiments of the present invention.

DETAILED DESCRIPTION OF THE PREFERRED EMBODIMENTS

Figure 1:
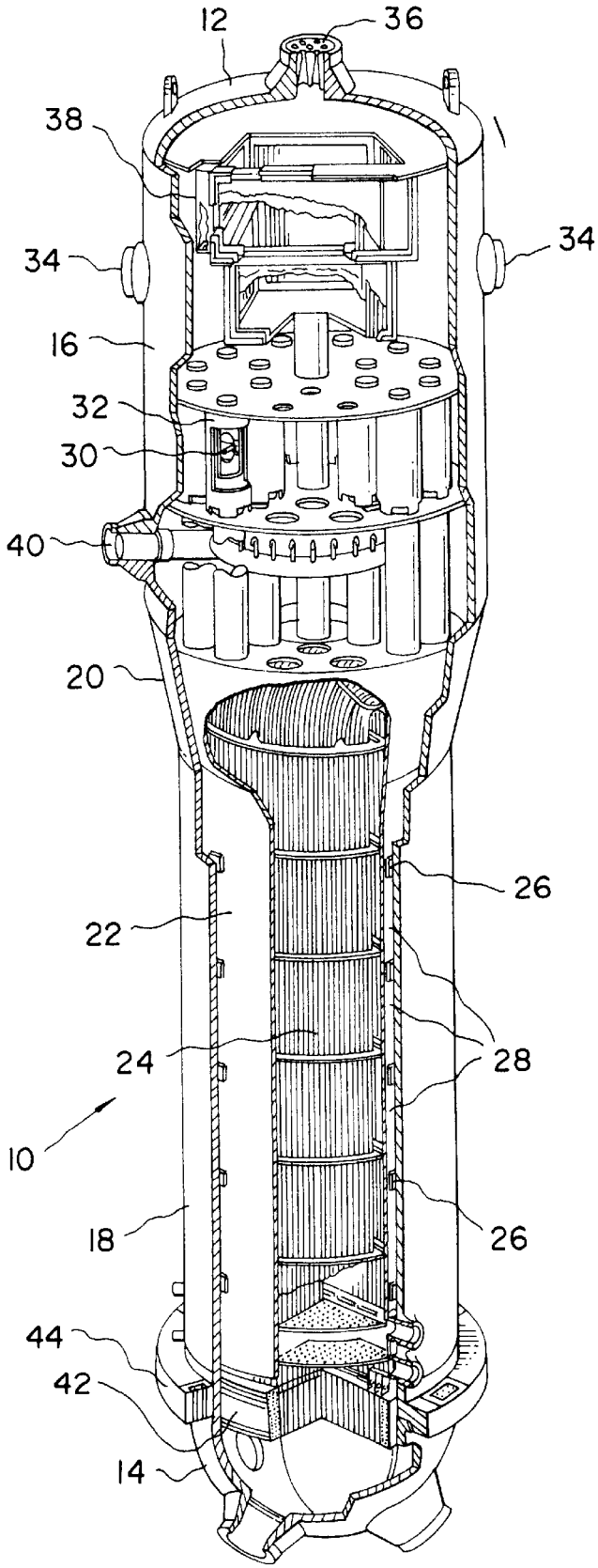
FIG. 1 is a cutaway perspective view of a steam generator in a nuclear power plant.

In a pressurized-water, nuclear-powered, electric generating plant, heat generated by a nuclear reactor is absorbed by a primary coolant that circulates through a reactor core and transfers heat to produce steam inside a steam generator 10 shown in FIG. 1. The steam generator 10 is typically an upright cylindrical pressure vessel with an upper hemispherical end section 12 and a lower hemispherical end section 14. The steam generator 10 has an upper external steel shell 16 and a lower external steel shell 18. Note that the upper shell 16 has a wider diameter than the lower shell 18 and is separated therefrom by a transition cone 20.

Inside the lower shell 18 and the transition cone 20, there is a wrapper barrel 22 of thin carbon steel surrounding a tube bundle 24 which is an array of individual tubes extending from an upper portion of the transition cone 20 downwardly to a predetermined space at a bottom of the lower shell 18.

The tube bundle 24 inside the wrapper barrel 22 is the main source of heat transfer and also is a radiation source emitting most of the doses absorbed by nuclear power plant workers.

The wrapper barrel 22 is supported by wedges 26 and anti-rotation devices (not shown) inside an annular space 28 formed between the wrapper barrel 22 and the lower shell 18.

The upper shell 16 has its interior space dedicated to separating moisture from wet steam which is generated during an operating cycle. Primary moisture separation is accomplished through angled vanes 30 inside swirl barrels 32 that throw off excess moisture through centrifugal steam action.

Entrance into the interior space of the upper shell 16 is made by a worker through one of two manways 34 of which each has a circular opening with a 16-inch diameter. Because of the distance from each manway 34 to the tube bundle 24, there is generally a low field of only one to five millirads of gamma rays per hour at the opening such that the radiation dosage is not a cause for concern about the worker's health.

The main concern at this height of the generator 10 is venting for a safe atmosphere, i.e. oxygen. Also, there is a need to document equipment that is introduced and persons who enter through the manway 34. No lead shielding is necessary at this upper level.

For the sake of completeness, other elements of the upper shell 16 shown in FIG. 1 are a steam nozzle 36, positive entrainment steam dryers 38, and a feed water nozzle 40. At the lower shell 18, there is a thick horizontal plate called a tubesheet 42 surrounded by a support ring 44.

Figure 2:
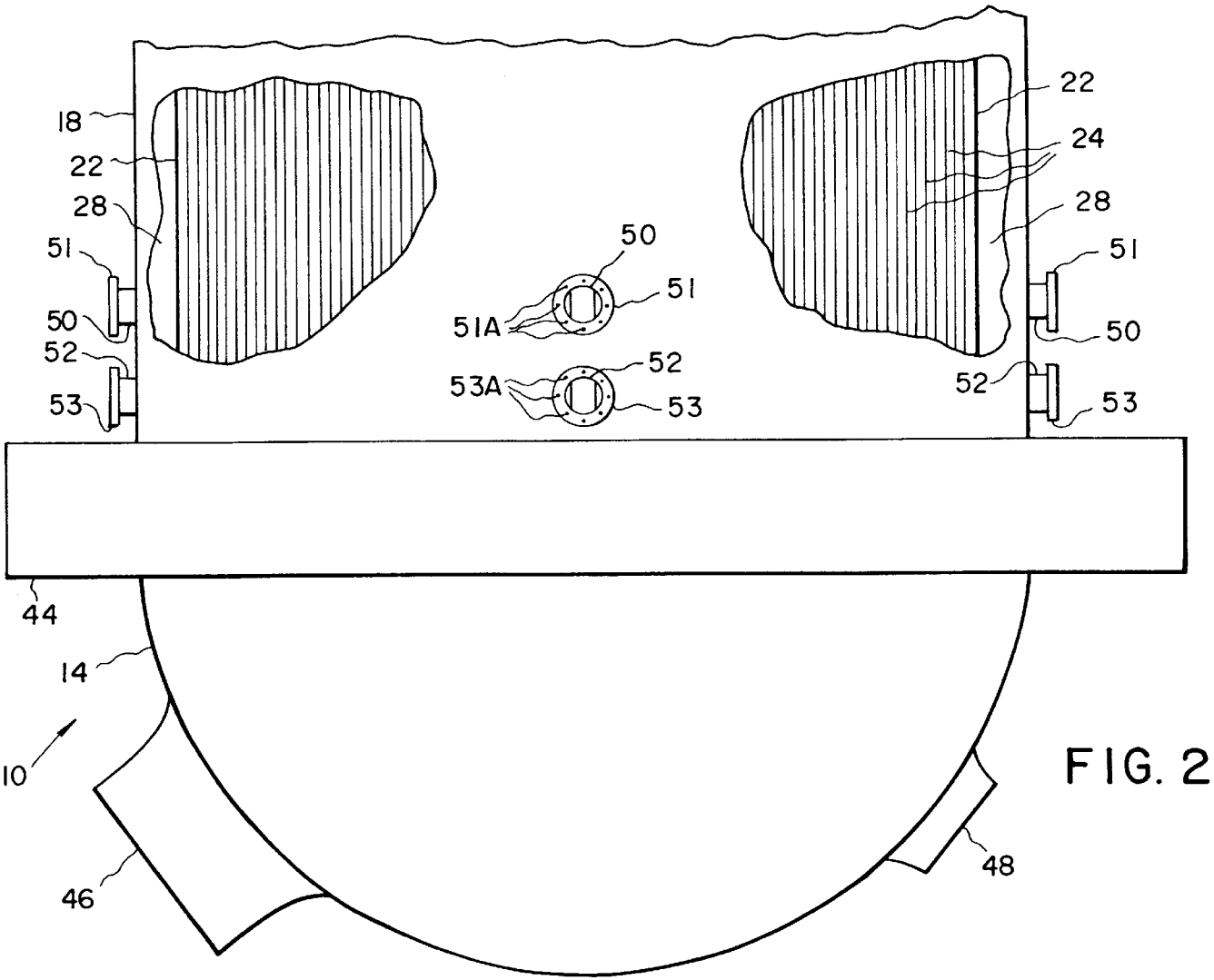
FIG. 2 is a partially cutaway front elevation view of a lower portion of the steam generator.

In FIG. 2, the lower hemispherical end section 14 and the bottom of the lower shell 18 are shown. Also, the wrapper barrel 22, the tube bundle 24, and the annular space 28 are illustrated in two cutaway views.

Along the curvature of the end section 14, there is a primary water inlet nozzle 46 and a primary water outlet nozzle 48. At a transition area between the end section 14 and the bottom of the lower shell 18, there is the support ring 44.

Access to the area of the tubesheet 42 of FIG. 1 inside the support ring 44 of FIG. 2 is made through either two or four six-inch openings in handholes 50 situated at either 180° or 90°, respectively, around the bottom of the lower shell 18. However, the six-inch diameters of the openings in the handholes 50 may vary, depending upon the model of the steam generator 10.

The handholes 50 in FIG. 2 have the same general purpose as the manway 34 shown in FIG. 1, i.e. to maintain, service and inspect vital components inside the generator 10. However, the three embodiments deal primarily with the handholes and the inspection ports due to the higher level of radiation inside the lower shell 18 than inside the upper shell 16.

Other circular openings, such as visual inspection ports 52 seen in FIG. 2, can have the same but generally smaller diameters than the diameters of the handholes 50. These ports 52, like the handholes 50, may be arranged around an outer circumference of the lower shell 18 at either 90° or 180° from each other. In FIG. 2, three of the four handholes 50 and their corresponding inspection ports 52 are seen at 90° from each other.

Each handhole 50 have a flange 51 with bolt holes 51A. Likewise, each inspection port 52 has a flange 53 with bolt holes 53A.

Figure 3:
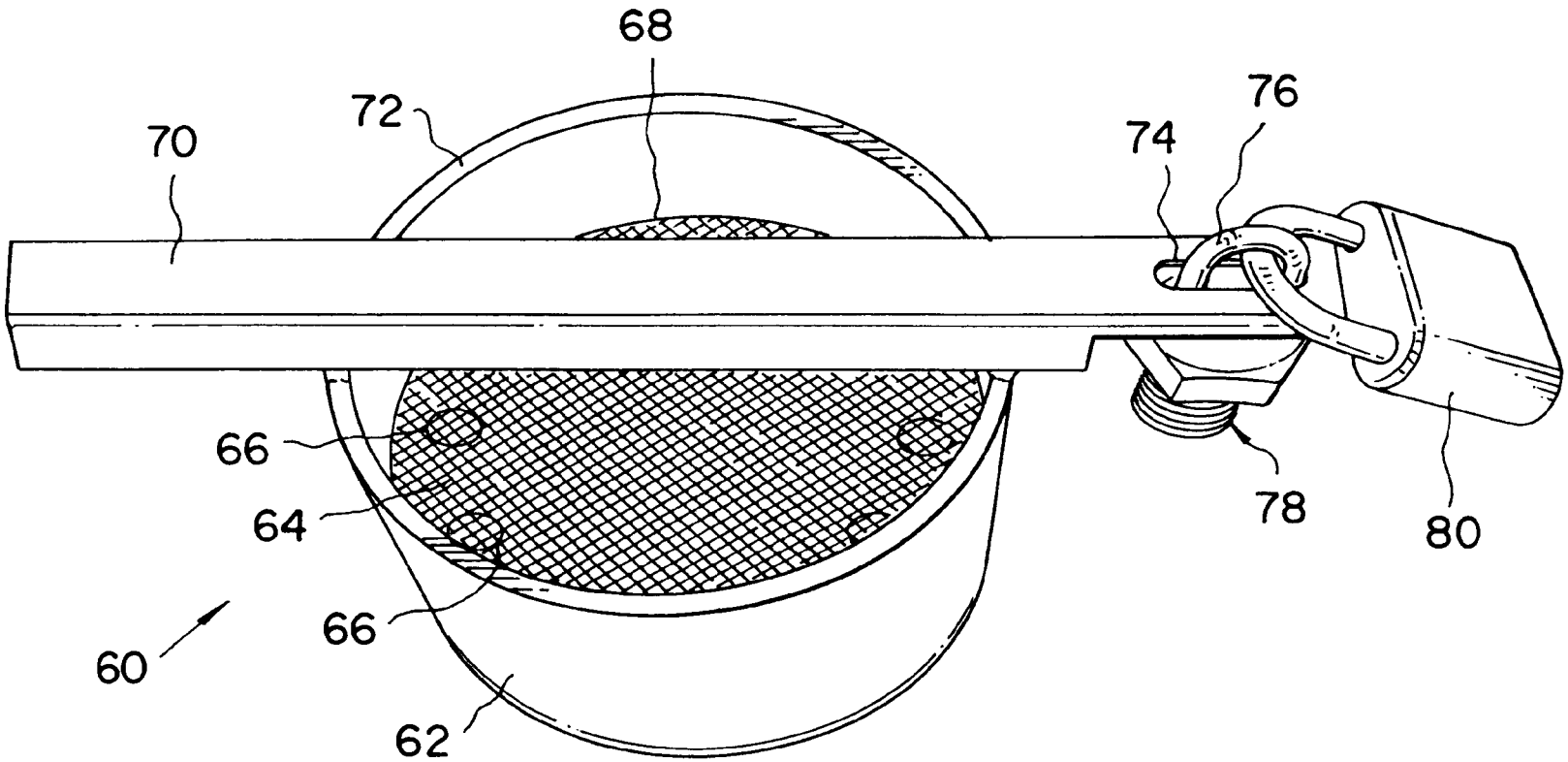
FIG. 3 is a perspective view of a first embodiment of the present invention.

In FIG. 3, a perspective view of a first preferred embodiment of the present invention is shown. A temporary cover 60 has a cylindrical metal sleeve 62 with an outer diameter which is slightly smaller than an inner diameter of the opening. In other words, the handhole 50 or the inspection port 52 in FIG. 2 is matched with the sleeve 62 in FIG. 3 and the sleeve 62 is inserted in the selected handhole 50 or port 52.

A solid lead plate shield 64 has a thickness which reduces by absorption the radiation from a source inside the tube bundle 24 of FIGS. 1 and 2 to approximately one-tenth or less of its initial energy. Depending upon the necessary shielding required and the intensity of the radiation source, the shield 64 with a thickness of two inches of lead is usually sufficient to obtain the desired reduction in harmful gamma rays.

Vent holes 66 are machined by drilling into the shield 64 to provide for adequate circulation of air. The plurality of vent holes 66 typically comprises approximately five cubic inches of volume in the cylindrical shield 64 which has a six-inch diameter and a two-inch thickness. A mesh screen 68 is placed entirely over an external surface of the shield 64 to prevent the accidental or purposeful insertion of foreign objects into one or more of the vent holes 66.

An elongated bar 70 is fillet-welded to an outer circumferential edge 72 of the sleeve 62 in order to prevent the sleeve 62 from slipping into the opening in either the handhole 50 or the inspection port 52 in FIG. 2 and falling down on top of the tubesheet 42 seen in FIG. 1.

Returning to FIG. 3, the bar 70 has a slot 74 cut into one end through which a D-shaped ring 76 on a head of a bolt 78 is secured by a lock 80. Although the lock 80 may be opened and closed with a key (not shown), a resettable combination is preferred because it can be changed from time to time.

The temporary cover 60 is now ready to be plugged and secured into the opening of either the handhole 50 or the inspection port 52 of FIG. 2 by the elongated bar 70 which serves as a handle. Thus, the cover 60 functions as a radiation block via the lead plate shield 64, a vent through the plurality of holes 66, a foreign object excluder due to the mesh screen 68, and a nonremovable device because of the D-shaped ring 76 which is secured in the slot 74 of the bar 70 by the lock 80.

Figure 4:
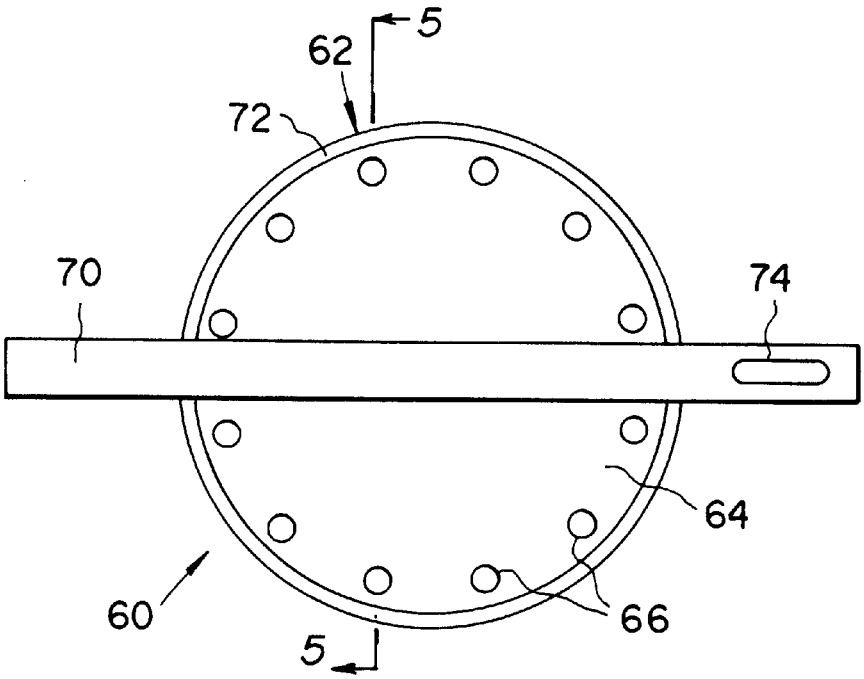
FIG. 4 is a front elevation view of the first embodiment.

In FIG. 4, there is shown a top plan view of the cover 60 without the mesh screen 68 of FIG. 3. The elongated bar 70 is fillet-welded onto the outer circumferential edge 72 and extends over two sides of the sleeve 62. The plurality of vent holes 66 is arranged around an outer periphery of the lead plate shield 64. In this first embodiment, there are 12 vent holes 66 in an equally spaced array from the center of the lead plate shield 64. Of course, more or less vent holes 66 of small or larger diameters, respectively, may be drilled as long as the total area of openings for the vent holes 66 and their angles do not impede shielding. The size of the vent holes 66 and their angles will vary with the diameter and the thickness of the shield 64. The slot 74 is seen in the one end of the elongated bar 70 without the D-shaped ring 76 and the lock of FIG. 3.

Figure 5:
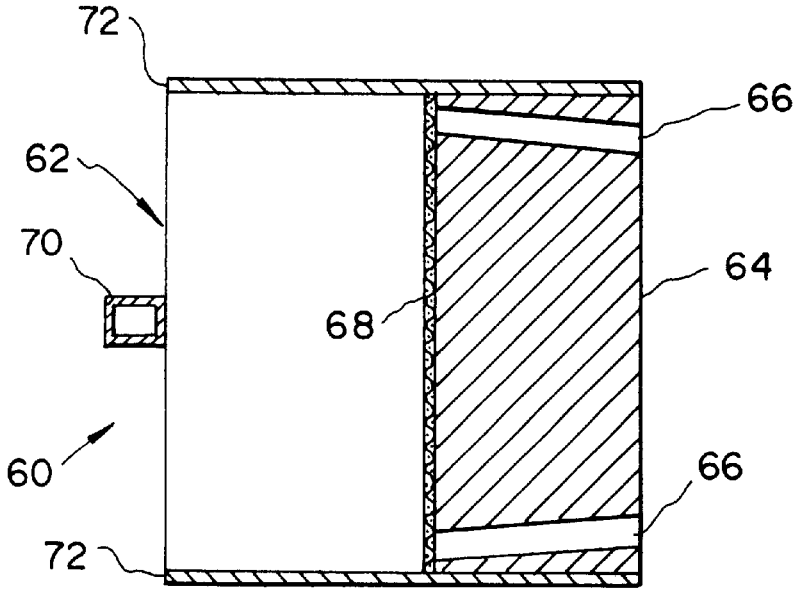
FIG. 5 is a cross-sectional side elevation view taken along line 5—5 in FIG. 4.

In FIG. 5, a cross-sectional, side elevation view taken along line 5—5 in FIG. 4 shows the elongated bar 70 of the cover 60 to be a hollow square tube. Inside the outer edges 72 of the sleeve 62, there is the mesh screen 68 fillet-welded in front of the solid lead plate shield 64. Two of the 12 vent holes 66 drilled through the lead plate shield 64 are shown to be inclined at an angle. This angle may vary from 70 to 25° from the longitudinal axis of the sleeve 62.

Because gamma rays travel in a linear manner, i.e. in a straight line, from their radiation source and do not bend around corners, the inclined vent holes 66 prevent the majority of the gamma rays from escaping therethrough while simultaneously allowing air to circulate in and out of the openings. Gamma radiation that emerges through the vent holes 66 is channeled away from the operator. In other words, the majority of gamma rays from the radiation source on the right side of the lead shield 64 are absorbed and diffused by the lead in the plate shield 64 at the same time that air is adequately vented through the holes 66, thus protecting a worker on the left side of the temporary cover 60.

Figure 6:
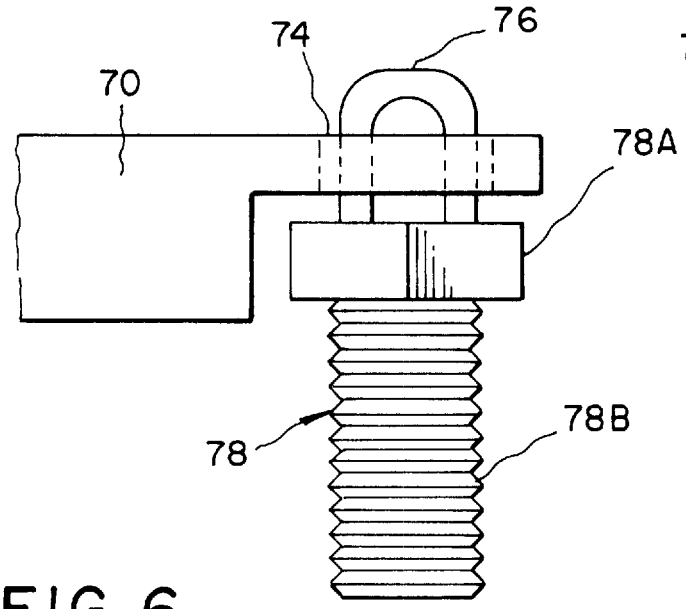
FIG. 6 is an enlarged, detailed, side elevation view of one end of the first embodiment shown in FIG. 3.

FIG. 6 shows a close-up detailed view of the one end of the elongated bar 70. At this one end, the slot 74 receives the D-shaped ring 76 formed integrally on a head 78A of the threaded bolt 78. A body 78B of the bolt 78 is threaded, with reference to FIG. 2, into either one of the bolt holes 51A in the flange 51 or one of the bolt holes 53A in the flange 53 so that the temporary cover 60 of FIG. 3 may be secured by the lock 80 into either the handhole 50 or the inspection port 52, respectively, seen in FIG. 2.

Figure 6A:
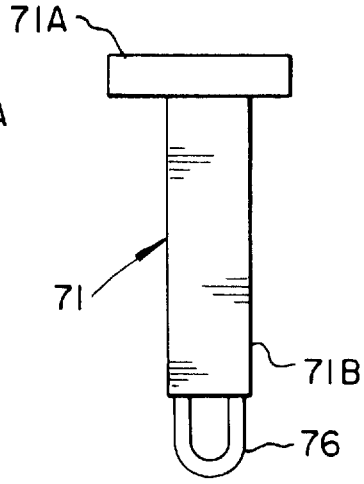
FIG. 6A is a side elevation view of a pin which can be used instead of the bolt shown in FIG. 6.

FIG. 6A shows an unthreaded pin 71 which may be substituted for the threaded bolt 78 in FIG. 6. The pin 71 has a head 71A and a body 71B. The D-shaped ring 76 is welded to a distal end of the body 71B instead of to a top of the head 71A. The lock 80 in FIG. 3 is secured through the D-shaped ring 76 to prevent the pin 71 from slipping out of the slot 74 in FIG. 6.

Figure 7:
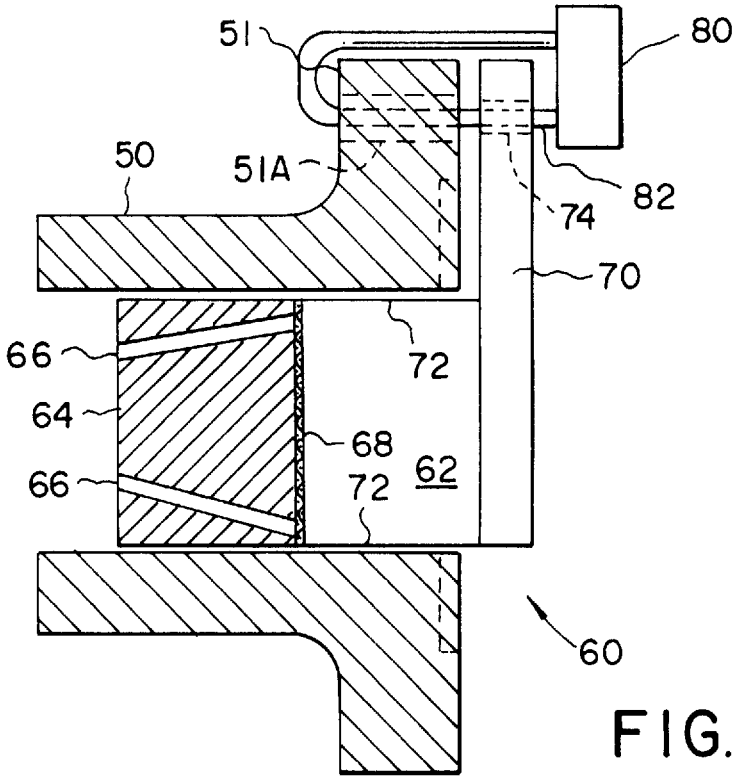
FIG. 7 is a cross-sectional top plan view of a second embodiment.

FIG. 7 shows a second embodiment of the temporary cover 60 plugged into the inspection port 52. Inside the outer edges 72 of the cylindrical sleeve 62, there is a mesh screen 68 placed over the lead plate shield 64 through which vent holes 66 are inclined at an angle in the range of 7° to 25° from the front outer periphery towards a rear center of the lead plate shield 64.

However, the cover 60 of the second embodiment differs from the cover 60 of the first embodiment shown in FIGS. 3–6A in that the elongated bar 70 in FIG. 7 extends beyond only one side of the outer circumferential edge 72 of the sleeve 62.

The slot 74 at the one end of the bar 70 receives a leg 82 of the lock 80 instead of receiving the D-shaped ring 76 of the threaded bolt 78 illustrated in FIGS. 3 and 6. In FIG. 7, the leg 82 of the lock 80 extends through one of the bolt holes 51A in the flange 51 of the handhole 50. Alternatively, the leg 82 may extend through one of the bolt holes 53A in the flange 53 if the inspection port 52 of FIG. 2 is being temporarily plugged by the cover 60.

With reference to FIGS. 2 and 7, the reader must realize that usually, during operation of the pressurized steam generator 10 shown in FIG. 1, the handholes 50 and the inspection ports 52 are tightly and permanently plugged by a heavy cover (not shown) that is secured over a gasket (not shown) by bolts or studs and nuts (not shown) threaded through the bolt holes 51A and 53A of the flanges 51 and 53, respectively.

However, when the nuclear power plant is shut down periodically for routine maintenance, each steam generator 10 is taken out of service and cleaned. To prevent radiation from escaping through the handholes 50 and the inspection ports 52 seen in FIG. 2, a plurality of the temporary covers 60 are plugged therein.

Although the second embodiment of FIG. 7 is used where the bolt holes 51A and 53A of FIG. 2 are unthreaded bores extending completely through the flanges 51 and 53, respectively, the first embodiment of FIGS. 3–6A can also be used where the bolt holes 51A and 53A of FIG. 2 are unthreaded holes in the flanges 51 and 53, respectively, because the pin 71 of FIG. 6A can be inserted from a rear of the flanges 51 and 53 and still hold the cover 60 of FIGS. 3–6A in either the handhole 50 or the inspection port 52 of FIG. 2.

Figure 8:
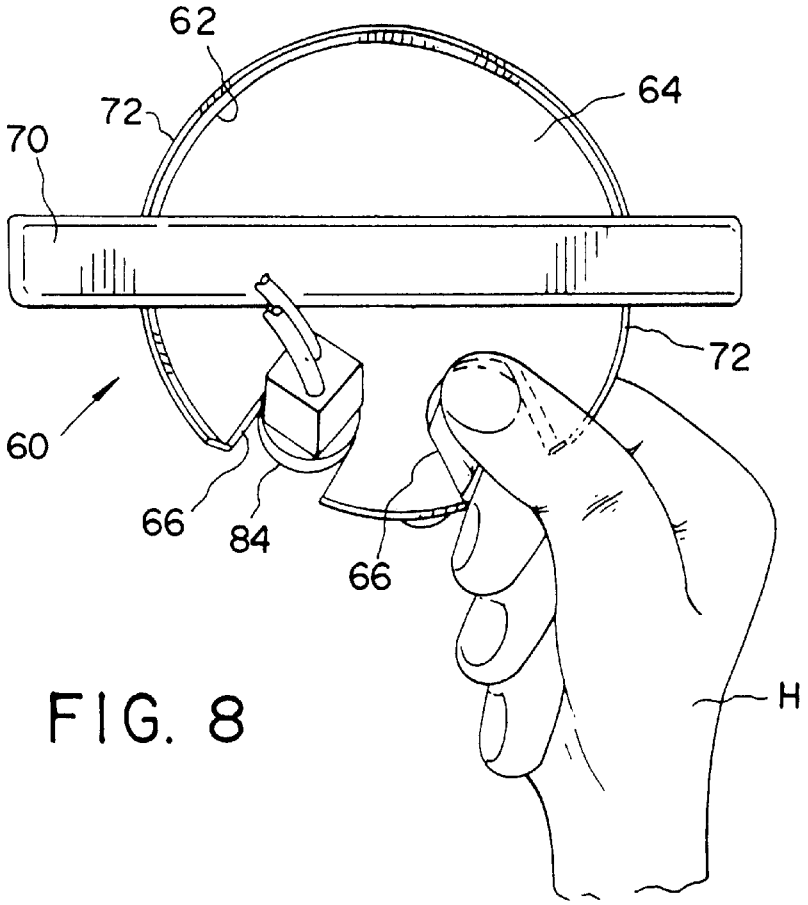
FIG. 8 is a front elevation view of a third embodiment.

In FIG. 8, there is illustrated a third embodiment of the temporary cover 60 with its elongated bar 70 fillet-welded to the outer circumferential edge 72 of the cylindrical sleeve 62. Inside the sleeve 62, there is the lead plate shield 64.

However, instead of having the plurality of small vent holes 66 as in the first embodiment of FIGS. 3–6A and the second embodiment of FIG. 7, the third embodiment has only two large vent holes 66 which allow an operator's hand H to insert two guide tubes (not shown). Through these guide tubes, a small camera 84 or a retrieval tool (not shown) are inserted for finding and grasping a dropped tool (not shown) or a foreign object (not shown).

Note that the elongated bar 70 does not have a slot 74. The reason for this omission is that this third embodiment is intended for immediate use and is not supposed to be left unattended after a foreign object is removed. Unlike the first embodiment of FIGS. 3–6A and the second embodiment of FIG. 7, the third embodiment of the temporary cover 60 cannot be locked in place and left overnight. Thus, when the operator is finished making a search and a retrieval, he or she must promptly replace the temporary nonlocking cover 60 of FIGS. 8 and 9 with one of the temporary locking covers 60 of FIGS. 3–6A or 7. The permanent cover (not shown) that is usually bolted to flange 51 or 53 of the handhole 50 or the inspection port 52, respectively, seen in FIG. 2, is then installed after all maintenance is finished.

Figure 9:
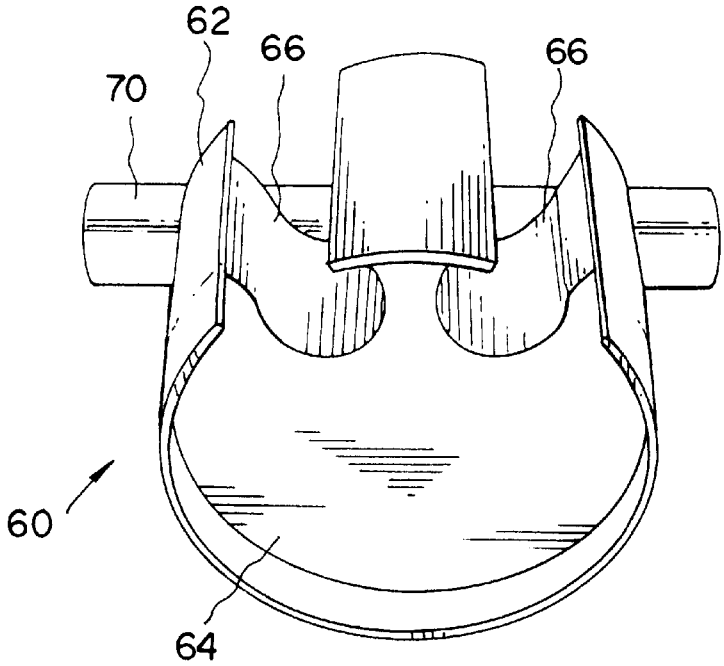
FIG. 9 is a rear perspective view of the third embodiment.

In FIG. 9, there is illustrated a rear perspective view of the third embodiment of the temporary cover 60. The cylindrical sleeve 62 is seen with the shield 64 having the two slightly inclined vent holes 66 bored therethrough and opened to the outer circumferential edge 72 of the sleeve 62. The elongated bar 70, which serves as a handle to put the cover 60 into place and to prevent the cover 60 from falling inside the steam generator 10 of FIG. 1, is attached to the outer edge 72 of the sleeve 62.

The cover 60 is kept in place in the handhole 50 or the inspection port 52 during an inspection being made when the two guide tubes (not shown) are inserted through the large vent holes 66 illustrated with open sides extending to the outer circumferential edge 72 of the cylindrical sleeve 62 in FIGS. 8 and 9. The small camera 84 is slipped through one guide tube (not shown) to search for and find the foreign object. When it is located, the retrieval tool (not shown) is slipped through the other guide tube (not shown) to grasp and remove the foreign object (not shown).

The outer circumferential edge 72 of the cylindrical sleeve 62 is smooth so as to allow quick and easy removal of the cover 60 from the handhole 50 or the inspection port 52. Thus, the foreign object will not be dropped back in and possibly lost again inside the steam generator 10. Furthermore, when the cover 60 is in place in the handhole 50 or the inspection port 52, it provides protection by reducing radiation to less than one-tenth of its value before the gamma rays strike the shield 64.

Because the two vent holes 66 are so large and are inclined at only a slight angle, more radiation escapes through the holes 66 in this third embodiment than the first embodiment of FIGS. 3–6A and the second embodiment of FIG. 7. However, the operator is aware of the increased exposure to the gamma rays. Therefore, he or she will know to stay out of the direct path of the radiation or stay behind lead shielding before undertaking any work using this third embodiment of the cover 60.

The above-described embodiments are not intended to be the only manner in which the invention is made. Instead, the scope and the spirit of the invention are defined by the appended claims.

What I claim as my invention is:

1. A temporary cover for plugging a selected one of a handhole and an inspection port in a steam generator of a nuclear power plant, said cover comprising:

a cylindrical sleeve having an outer circumferential edge;

a lead plate shield positioned inside the sleeve, said shield having a plurality of vent holes therethrough; and an elongated bar secured to the outer circumferential edge of the sleeve and configured to retain the sleeve with the shield in the selected one of the handhole and the inspection port.

2. A temporary cover according to claim 1, further comprising:

a mesh screen fitted over the shield inside the sleeve so that no foreign object may enter or exit through any one of the plurality of vent holes.

3. A temporary cover according to claim 1, wherein:

each one of the plurality of vent holes is inclined at an angle in the range of 7° to 25° from a longitudinal axis of the sleeve.

4. A temporary cover according to claim 1, wherein:

each one of the plurality of vent holes is inclined at an angle from a longitudinal axis of the sleeve so that approximately no more than 10% of gamma rays approaching the shield from a radiation source are allowed to pass through the vent holes.

5. A temporary cover according to claim 1, wherein:

said plurality of vent holes numbers two and each of the plurality of vent holes is open to the outer circumferential edge of the cylindrical sleeve for easy detachment of tools.

6. A temporary cover according to claim 1, wherein:

said plurality of vent holes numbers 12.

7. A temporary cover according to claim 1, wherein:

a total area of openings for the plurality of vent holes does not exceed 20% of a total surface area of the shield.

8. A temporary cover according to claim 1, wherein:

said shield has a thickness of lead plate such that no more than 10% of gamma rays approaching the shield from a radiation source pass through the shield.

9. A temporary cover according to claim 1, wherein:

said elongated bar extends beyond two sides of the sleeve.

10. A temporary cover according to claim 1, wherein:

said elongated bar extends beyond only one side of the sleeve.

11. A temporary cover according to claim 1, wherein:

said elongated bar has a slot being formed in one end extending over a side of the sleeve.

12. A temporary cover according to claim 11, wherein:

said slot is configured to receive a leg of a lock.

13. A temporary cover according to claim 11, further comprising:

a D-shaped ring formed on a head of a threaded bolt and configured to extend into the slot.

14. A temporary cover according to claim 13, further comprising:

a lock configured to retain the D-shaped ring in the slot.

15. A temporary cover according to claim 14, wherein:

said lock is a resettable combination type.

16. A temporary cover according to claim 11, further comprising:

a D-shaped ring formed on a distal end of an unthreaded pin configured to extend into the slot.

17. A temporary cover according to claim 16, further comprising:

a lock configured to retain the unthreaded pin in the slot.

18. A temporary cover according to claim 17, wherein:

said lock is a resettable combination type.

* * * * *